US007217123B2

(12) United States Patent
Schmeler

(10) Patent No.: US 7,217,123 B2
(45) Date of Patent: May 15, 2007

(54) COOLED FURNACE WALL

(75) Inventor: Robert Schmeler, Dudelange (LU)

(73) Assignee: Paul Wurth S.A., Luxembourg (LU)

( * ) Notice: Subject to any disclaimer, the term of this patent is extended or adjusted under 35 U.S.C. 154(b) by 37 days.

(21) Appl. No.: 10/552,415

(22) PCT Filed: Apr. 14, 2004

(86) PCT No.: PCT/EP2004/050518

§ 371 (c)(1),
(2), (4) Date: Oct. 6, 2005

(87) PCT Pub. No.: WO2004/090172

PCT Pub. Date: Oct. 21, 2004

(65) Prior Publication Data

US 2006/0208400 A1 Sep. 21, 2006

(30) Foreign Application Priority Data

Apr. 14, 2003 (EP) ..... 03008562
Jun. 5, 2003 (LU) ..... 91025

(51) Int. Cl.
*F27D 1/12* (2006.01)

(52) U.S. Cl. ..... 432/83; 373/76

(58) Field of Classification Search ..... 432/84, 432/83, 85; 122/511, 512, DIG. 13; 373/76
See application file for complete search history.

(56) References Cited

U.S. PATENT DOCUMENTS

| | | | | |
|---|---|---|---|---|
| 2,981,241 | A * | 4/1961 | Barton | 122/6 A |
| 3,829,595 | A * | 8/1974 | Nanjyo et al. | 373/76 |
| 4,435,814 | A * | 3/1984 | Buhler | 373/76 |
| 6,249,538 | B1 * | 6/2001 | Pavlicevic et al. | 373/76 |

FOREIGN PATENT DOCUMENTS

| | | |
|---|---|---|
| DE | 29608464 | 7/1996 |
| DE | 10049707 | 4/2002 |
| SU | 690894 | 4/1990 |

* cited by examiner

*Primary Examiner*—Gregory A. Wilson
(74) *Attorney, Agent, or Firm*—McCormick, Paulding & Huber LLP

(57) ABSTRACT

A cooled furnace wall comprises a furnace shell with an inner and an outer side and cooling plates lining the inner side of the furnace shell. Each of the cooling plates has a plate body and protruding connection pieces for supplying the cooling plate with a coolant. The furnace shell has connection openings therein for interconnecting the connection pieces of adjacent connection plates from the outer side of the furnace shell. At least one of the connection pieces is formed by a tube bend that protrudes from an edge face of the plate body and that has a connection end to extending through one of the connection openings in the furnace shell.

32 Claims, 12 Drawing Sheets

COOLED FURNACE WALL

CROSS-REFERENCE TO RELATED APPLICATIONS

This application is entitled to the benefit of International Application No. PCT/EP2004/050518 filed on Apr. 14, 2004. European Patent Application No. 03 008 562.5 filed on Apr. 14, 2003 and Luxembourg Patent Application No. 91 025 filed on Jun. 5, 2003.

FIELD OF THE INVENTION

The present invention generally relates to a cooled furnace wall. It relates more particularly to a furnace wall comprising a furnace shell with an inner side and an outer side and cooling plates lining the inner side of the furnace shell. Each of these cooling plates has a plate body with protruding connection pieces for a coolant. The furnace shell has connection openings therein, which enable to interconnect the protruding connection pieces of adjacent cooling plates from the outer side of the furnace shell.

BACKGROUND OF THE INVENTION

It is well known to line the inner side of a furnace shell of a metallurgical furnace, in particular a blast furnace, with cooling plates. Such a cooling plate, also called "stave", comprises a rectangular, solid plate body with cooling passages therein. Connection pieces, which protrude from the rear side of the cooling plate, debouch into the cooling passages of the cooling plate. These connection pieces are led in a sealed manner through connection openings in the furnace shell. At the outer side of the furnace shell, flexible metal tubes are used to interconnect the connection pieces of adjacent cooling plates and to connect the cooling plates to a cooling water distribution circuit.

The plate body of such a cooling plate is made either from cast iron (in particular modular cast iron) or from copper or a copper alloy, or more recently also from steel. In cooling plates made from cast iron, the cooling passages are generally formed by cast-in U-shaped steel tubes, wherein the ends of a cast-in tube protrude from the rear side of the plate body as connection pieces. In virtually all cooling plates made from copper or steel, however, the cooling passages are directly formed in the solid cooling plate body.

DE 2 907 511 discloses a cooling plate which is made from a forged or rolled block of copper. The cooling passages in the copper block are blind bores produced by mechanical deep-drilling. The openings of these blind bores are sealed off by soldering or welding plugs therein. Connecting bores are drilled from the rear side of the plate into the blind bores, and connection pieces for the coolant feed or coolant return are inserted into these connecting bores and soldered or welded in place.

WO 98/30345 describes a process for manufacturing a cooling plate in which a blank of the cooling plate is produced by continuous casting. Inserts in the continuous-casting mould produce passages running in the casting direction, which form the cooling passages in the finished cooling plate. A plate is separated from the continuously-cast blank by making two cuts transversely with respect to the casting direction, thus forming two end faces, wherein the distance between these two end-faces corresponds to the desired length of the cooling plate. In the next manufacturing step, connection bores are drilled into the plate body perpendicular to its rear surface, so as to open into the through-passages. Thereafter connection pieces are inserted into the connection bores and soldered or welded in place and the end-side openings of the passages are sealed off by soldering or welding plugs therein.

The processes described in DE A 2907511 and in WO 98/30345 both enable high-quality cooling plate bodies to be produced from copper or copper alloys. However, compared to cooling plates with cast-in cooling tubes or compared to mould-cast cooling plates, the finished cooling plates produced by both processes have the drawback of relatively high pressure losses in the transition regions between the connection pieces and the cooling passages.

WO 00/36154 proposes to reduce the pressure losses in copper cooling plates with cast or drilled cooling passages by inserting a shaped piece into a cut-out in the cooling plate body, so as to form a diverting passage with optimised flow conditions for the cooling medium. However, this solution is relatively labour-intensive and results therefore in higher production costs for the cooling plates.

DISCLOSURE OF INVENTION

Technical problem

It is an object of the present invention, to optimise the connections between the cooling plates in a furnace wall as defined in the preamble.

OBJECTS AND SUMMARY OF THE INVENTION

According to a first aspect of the present invention, this object is achieved through the fact that a connection piece of a cooling plate is formed by a tube bend that protrudes from an edge face (i.e. a narrow side face) of the plate body and that has a connection end extending through one of the connection openings in the furnace shell. A connection piece of this type may, for example, be formed by a 90° tube bend, a first end of which is inserted into an opening of a cooling passage in the edge face of the plate body. In other words, the connection piece no longer opens perpendicularly through the rear side of the cooling plate body into the cooling passage, but rather in axial extension of the cooling passage through an edge face of the cooling plate body. The cooling fluid is consequently diverted within the tube bend connection piece itself, which causes relatively low pressure losses.

It will also be appreciated that production of a cooling plate with cooling passages formed directly in a solid plate body is significantly simplified by the present invention. In fact, the openings of the cooling passages in the edge faces of the cooling plate body no longer have to be sealed by soldering or welding plugs therein, and there is also no need to drill separate connection passages for the connection pieces from the rear side of the cooling plate. In the process which is known from DE-A-2907511, the blind bores can be replaced by through-bores, which simplifies cleaning of the drilled cooling passages. Moreover, dead end sections (i.e. passage end sections through which there is no flow), in which sand, weld beads and rust particles normally accumulate and/or air pockets or vapour bubbles form, are avoided, which will result in an improved cooling capacity and service life of the cooling plates. Also the cooling of the bottom and top ends of the cooling plates is significantly improved, since the cooling medium now flows directly through these top and bottom ends.

Cooling plates with cooling passages directly formed in a solid plate body may, for example, comprise a continuously cast cooling plate body made from copper or a copper alloy with cast-in cooling passages, a forged or rolled cooling plate body made from copper or a copper alloy with drilled or milled cooling passages, or a cooling plate body made from steel with drilled or milled cooling passages. In the case of a cooling plate body made from copper or a copper alloy, tube bends made from copper or a copper alloy or from stainless steel will normally be used. In the case of a cooling plate body made from steel, steel tube bends are preferred.

Generally, vertical cooling plates, i.e. cooling plates with vertically running cooling passages, are used in the context of the present invention. It is however also possible to use horizontal cooling plates, meaning cooling plates with horizontally running cooling passages. In the case of vertical cooling plates, a cooling passage forms an opening in an upper or lower edge face of the cooling plate body. In the case of horizontal cooling plates, a cooling passage forms an opening in the left-hand or right-hand edge face of the cooling plate body.

In accordance with the present invention, the tube bend connection pieces of two adjacent cooling plates connected in series may lie relatively close together. This is of advantage with regard to the arrangement of the connection openings in the furnace shell and the interconnection of the connection pieces.

The tube bend connection pieces of two cooling plates are preferably connected by means of flexible connection means. In accordance with another aspect of the present invention, these flexible connection means are accommodated in a sealed connection box which is arranged on the outer side of the furnace shell and is preferably closed off by means of a removable blind flange. This eliminates the need for expensive, sealed tube passages through the furnace shell and results in significant time savings when mounting the cooling plates. Furthermore, it will be appreciated that a connection box of this type may also be dimensioned in such a manner that a cooling plate can be removed from the furnace and introduced into the furnace through the connection box.

The flexible connection means advantageously comprises a tube compensation bend which connects the tube bend ends of two cooling plates in the connection box and compensates for differential movements of the cooling plates. Compared to a conventional metal hose, a tube compensation bend of this type produces significantly lower pressure losses and moreover has a longer service life.

To reduce the distance between the edge faces of two adjacent cooling plates, the second ends of the tube bends of the first cooling plate and the second ends of the tube bends of the second cooling plate may be arranged in a row. In this case, the flexible connection means may, for example, comprise a bent tube segment which is arranged in the connection box and is substantially in the shape of racing cycle handlebars. A shape of this type ensures the required resilience to absorb differential movements of the cooling plates.

As an alternative solution to a connection box, the connection opening in the furnace shell may for example be covered by a socket piece. The latter has for each connection end a separate through-opening, and each of these connection ends is connected in a sealed manner to the socket piece by means of a compensator.

In order to protect the tube bends with respect to the interior of the furnace, a plate extension may be arranged in front of the tube bends at the edge face of the cooling plate.

If there are two rows of cooling plates arranged directly vertically above one another, the vertical joins between the cooling plates belonging to the upper row may be offset relative to the vertical joins between the cooling plates belonging to the lower row. In this arrangement, the tube bends of a cooling plate belonging to the lower row can be connected to the tube bends of two adjacent cooling plates belonging to the upper row.

The edge face of the plate body from which the connection pieces protrude is advantageously bevelled towards the inner side of the furnace shell. This allows two cooling plates which are to be connected by means of their connection pieces to be arranged significantly closer together. Furthermore, the bent connection pieces lie in the shadow of the bevelled cooling plate edge and are therefore at least partially protected from heat radiation from the furnace interior. If two cooling plates are to be connected, the opposite edge faces from which the connection pieces protrude are advantageously bevelled in a mirror image, so that they delimit a wedge-shaped space which narrows towards the interior of the furnace.

To enable two cooling plates which are to be connected by means of their connection pieces to be arranged even closer together, the connection piece has, at the outlet from the edge face of the plate body, a first curvature in the mid-plane of the plate body and thereafter a second curvature in a plane which is perpendicular to this mid-plane of the plate body. The connection piece may advantageously be composed of a 30° tube bend and a 90° tube bend, the centre lines of which lie in two planes which are perpendicular to one another. Two adjacent cooling plates can then be arranged above or next to one another in such a manner that the outlet of a connection piece in one edge face of the first cooling plate and the outlet of a connection piece in an opposite edge face of the second cooling plate lie axially opposite one another, wherein the first curvature of a bent connection piece of the first cooling plate is directed in a first direction and the first curvature of a bent connection piece of the second cooling plate is directed in the opposite direction. In this embodiment, the second curvatures of the bent connection pieces advantageously define parallel planes of curvature, the distance between which corresponds to 1.1 to 1.5 times the tube diameter of the bent connection pieces.

A plug made from an elastic material, in which there are through-openings for the connection ends, is advantageously inserted into a connection opening in the furnace shell. This plug advantageously has a lateral securing flange which is clamped between cooling plates and furnace shell. At least two connection ends are guided through the plug into a connection box on an outer side of the furnace shell, where they are connected to one another by means of flexible connection means. To improve the sealing of the connection box with respect to the interior of the furnace, a section of the connection box between the plug and the flexible connection means is advantageously sealed with a foamed sealing material. Moreover, the connection box may have a leak-test valve at its deepest point.

The present invention is also applicable to cooling plates which have at least one cooling passage which is formed by a cast-in tube. (This is for example the case with most cooling plates made from cast iron). For these cooling plates, at least one end of the tube protrudes from an edge face of the plate body and forms the tube bend connection piece.

BRIEF DESCRIPTION OF DRAWINGS

Preferred embodiments of the invention will now be described with reference to the accompanying drawings in which.

DESCRIPTION OF PREFERRED EMBODIMENTS OF THE INVENTION WITH REFERENCE TO THE DRAWINGS

Figure 1:
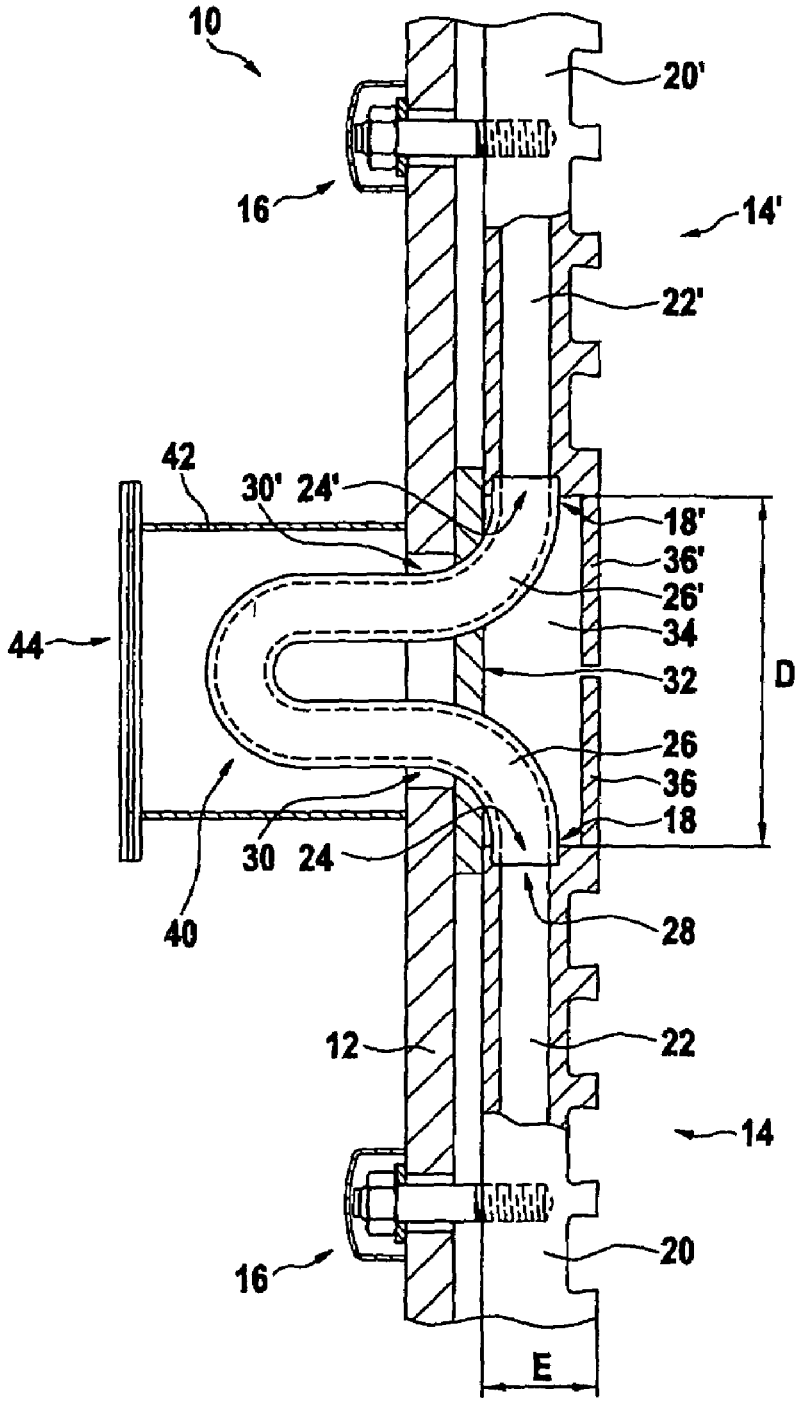
FIG. 1: is a longitudinal section through a first embodiment of a cooled furnace wall.
Figure 2:
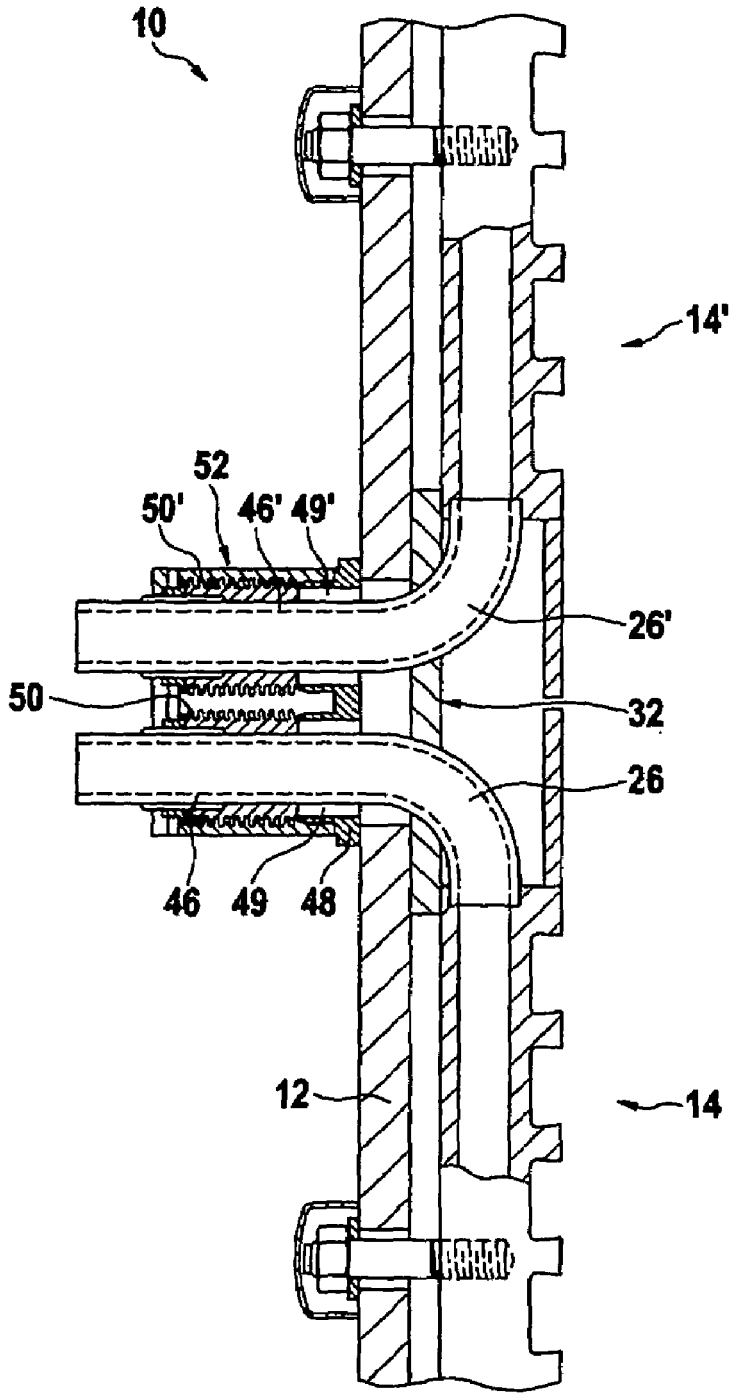
FIG. 2: is a longitudinal section through a second embodiment of a cooled furnace wall.

The furnace wall 10 shown in the drawings to illustrate the invention is a blast furnace wall cooled by means of cooling plates. In FIGS. 1 and 2, reference numeral 12 denotes a furnace shell. An upper end of a lower cooling plate 14 and a lower end of an upper cooling plate 14' can be seen on the inner side of the furnace shell 12. These cooling plates 14, 14' are affixed to the furnace shell 12 by means of threaded bolts 16 and form a cooled lining of the inner side of the furnace shell 12. "D" denotes the vertical distance between the upper edge face 18 of the lower cooling plate 14 and the lower edge face 18' of the upper cooling plate 14'. In the embodiments shown in FIG. 1 and FIG. 2, this distance "D" approximately corresponds to three times the thickness "E" of the cooling plates 14, 14'.

The cooling plates 14, 14' shown in FIG. 1 and FIG. 2 have a solid cooling plate body 20, 20' made from copper or a copper alloy. Vertical cooling passages 22, 22' are arranged directly in this solid cooling plate body 20, 20', i.e. they have, for example, been cast, drilled or milled into the base material of the cooling plate body 20, 20'. These cooling passages 22, 22' are formed as vertical through-passages which extend parallel through the cooling plate body 20, 20'. It can be seen from FIG. 1 and FIG. 2 that the cooling passage 22 forms an opening 24 in the upper edge face 18 of the lower cooling plate 14, and that the cooling passage 22' forms an opening 24' in the lower edge face 18' of the upper cooling plate 14'.

Reference numerals 26 and 26' denote thick-walled 90° tube bends made from copper which form connection pieces of the cooling plates 14, 14'. It can be seen that one end 28 of the lower tube bend 26 is welded or soldered into the openings 24 in such a manner that the second end 30 (also referred to as connection end 30) of the lower tube bend 26 faces a connection opening 32 in the furnace shell 12, and that one end 28' of the upper tube bend 26' is welded or soldered into the opening 24' in such a manner that the second end 30' (also referred to as connection end 30') of the upper tube bend 26' faces the same connection opening 32 in the furnace shell 12. In this arrangement, the two tube bends 26 and 26' lie vertically above one another in the free space which is formed between the upper edge face 18 of the lower cooling plate 14 and the lower edge face 18' of the upper cooling plate 14'. To shield the free space 34 in which the tube bends 26 and 26' are located with respect to the interior of the furnace, a plate extension 36, 36' is arranged both at the upper edge face 18 of the lower cooling plate 14 and at the lower edge face 18' of the upper cooling plate 14', in each case towards the interior of the furnace.

DETAILED DESCRIPTION OF THE INVENTION

In the embodiment shown in FIG. 1, the lower tube bend 26 is connected to the upper tube bend 26' by means of a compensation tube bend 40, the compensation tube bend 40 being welded to the free ends 30, 30' of the tube bends 26, 26'. This compensation tube bend 40 passes the cooling medium (generally cooling water) out of the cooling passage 20 into the cooling passage 20', wherein its resilience in the vertical direction compensates for temperature-related changes in the distance "D". The compensation tube bend 40 projects into a connection box 42 which is arranged on the outer side of the furnace shell 12 over the connection opening 32 in the furnace shell 12. This connection box 42 is connected in a gastight manner to the furnace shell 12 and is likewise closed off in a gastight manner by means of a removable blind flange 44. After removal of the blind flange 44 one has direct access to the compensation tube bend 40 from the outer side of the furnace shell 12.

Figure 13:
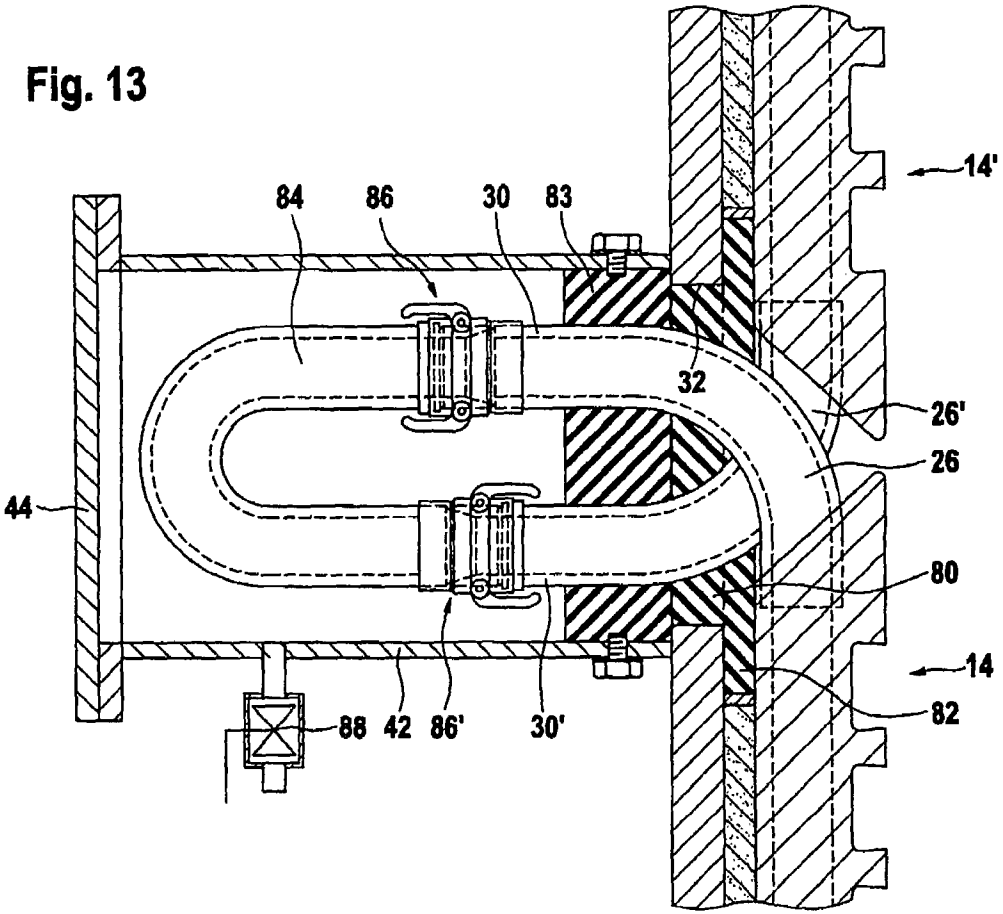
FIG. 13: is a longitudinal section as in FIG. 6, with further details.

In the embodiment shown in FIG. 2, extended connection ends 46, 46' of the tube bends 26, 26' are led in a sealed manner out of the furnace shell 12. For this purpose, the connection opening 32 in the furnace shell 12 is covered by a socket piece 48 which forms a passage 49, 49' for each connection end 46, 46'. Each connection end 46, 46' is in this case connected in a sealed manner to the socket piece 48 by means of a compensator 50, 50'. The compensators 50, 50' (bellows compensators are illustrated in FIG. 2) must be designed so as to be able to absorb lateral and angular movements of the connection ends 46, 46'. A common protective housing 52 surrounds the two compensators 50, 50'. In the embodiment shown in FIG. 2, the connection ends 46, 46' will be interconnected, for example, by means of a metal hose coupling as shown in FIG. 13. (The term "metal hose" shall also encompass a metallically reinforced synthetic hose).

Figure 3:
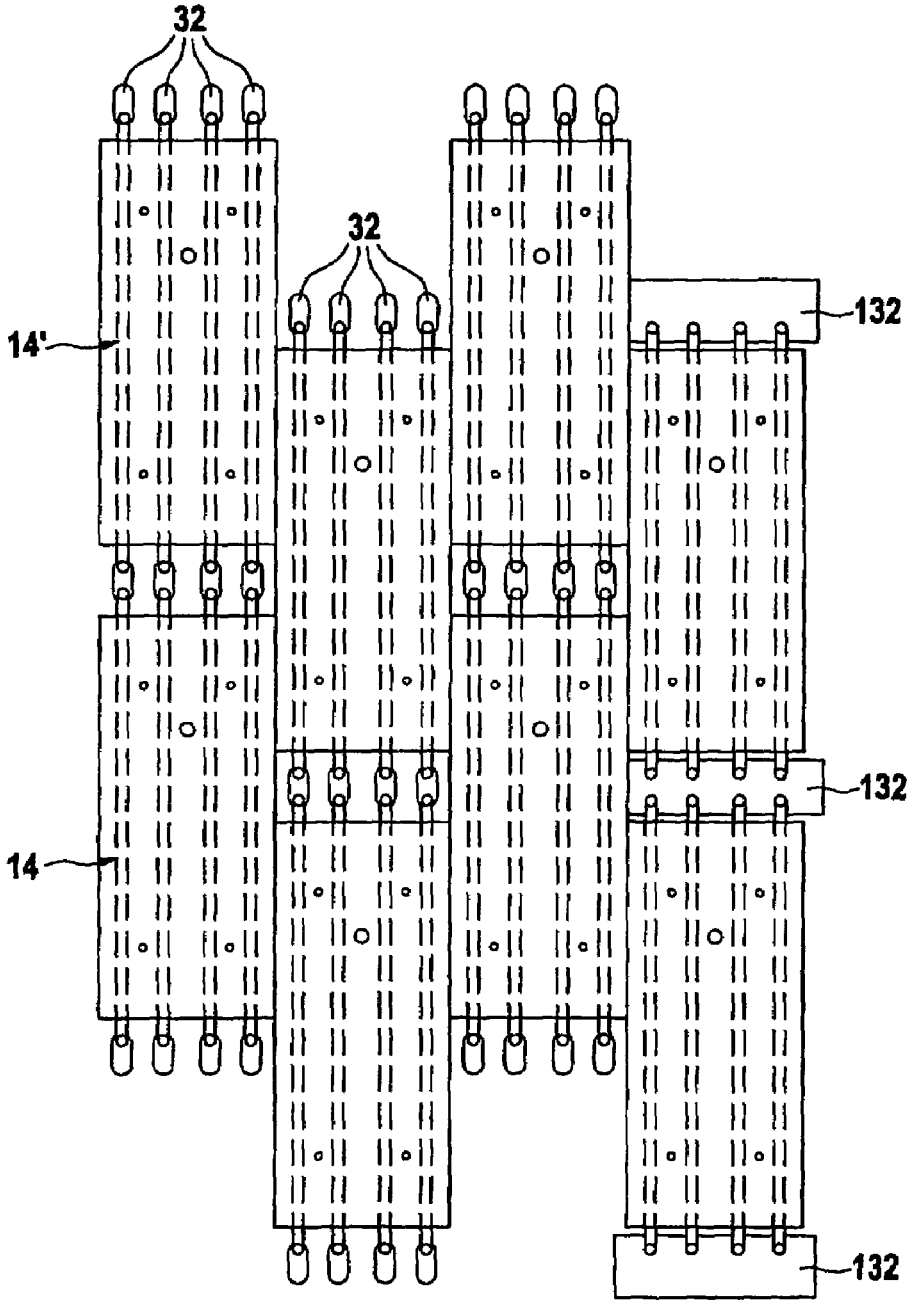
FIG. 3: is a plan view of a first arrangement of cooling plates in an embodiment of a cooled furnace wall.

FIG. 3 shows a first arrangement of cooling plates on the inner side of the furnace shell 12. The cooling plates 14, 14' are located vertically flush above one another, but the cooling plates of two adjacent columns are vertically offset by half the height of a cooling plate. As a result, the connection openings 32 in the furnace shell 12 are likewise vertically offset, so that the furnace shell 12 is weakened to a lesser extent. This is particularly important for the design variant indicated in the right-hand column. In this case, the connection opening 132 in the furnace shell 12 and the connection box 42 are dimensioned in such a manner that a cooling plate 14, after removal of the blind flange 44 and disconnection of the tube connections, can be removed from the furnace or introduced into the furnace through the connection box 42.

Figure 4:
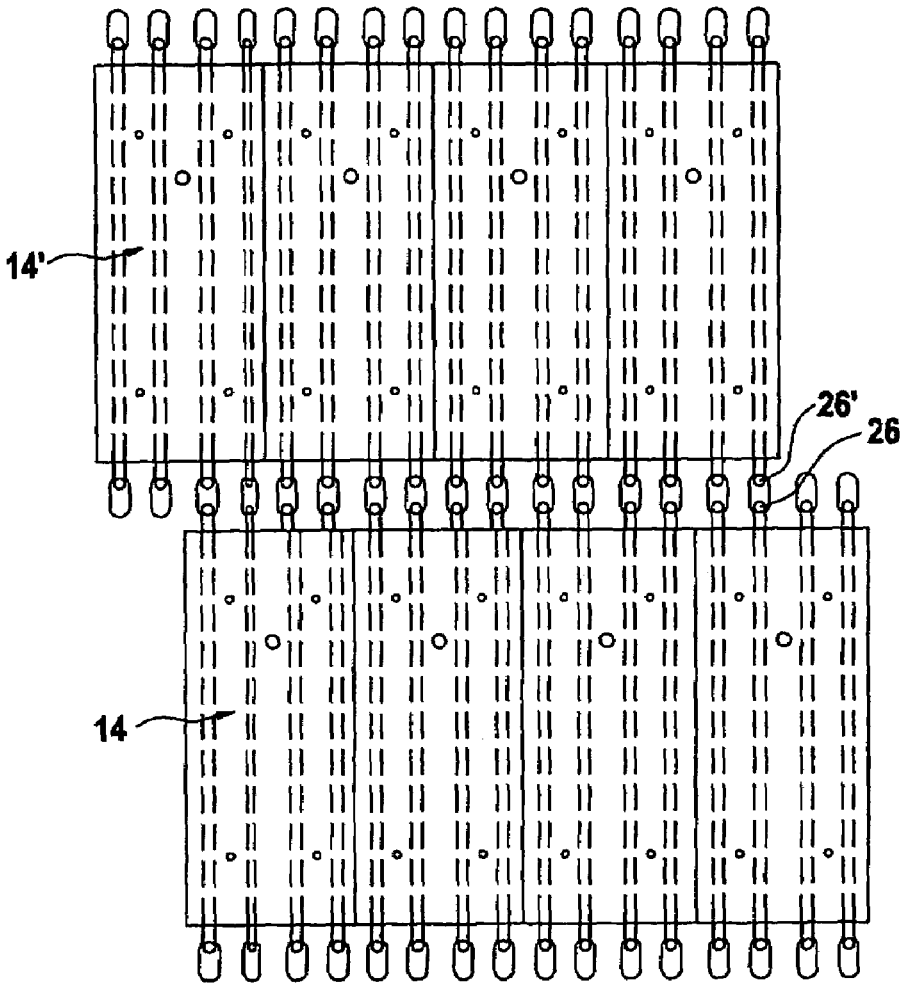
FIG. 4: is a plan view of a second arrangement of cooling plates in an embodiment of a cooled furnace wall.

FIG. 4 shows a second arrangement of cooling plates 14, 14' on the inner side of the furnace shell 12. These cooling plates 14, 14' are positioned in rows above one another, but the cooling plates of two adjacent rows are offset by half the width of a cooling plate. In this arrangement, the upper tube bends 26 belonging to a lower cooling plate 14 are in each case connected to tube bends 26' of two adjacent upper cooling plates 14'.

Figure 5:
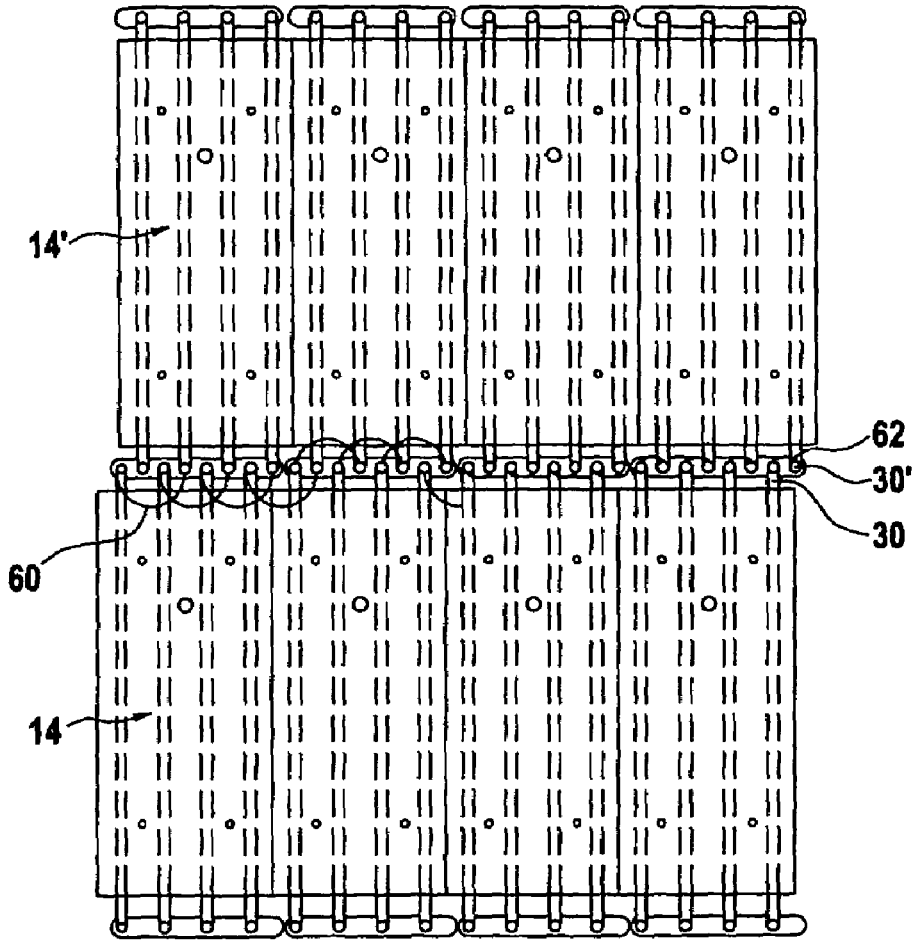
FIG. 5: is a plan view of a third arrangement of cooling plates in an embodiment of a cooled furnace wall.

FIG. 5 shows a third arrangement of cooling plates 14, 14' on the inner side of the furnace shell 12. These cooling plates 14 are likewise located in rows above one another, the cooling plates belonging to two adjacent rows being slightly offset. It will be observed that the ends 30 of the tube bends 26 belonging to the lower cooling plates 14 and the ends of the tube bends 26' belonging to the upper cooling plates lie in a row. As a result, the vertical distance "D" between the upper edge face 18 of a lower cooling plate 14 and the lower edge face 18' of an upper cooling plate 14' is reduced (and now approximately corresponds to twice the thickness "E" of the cooling plates 14, 14'). In the cooling plates of the left hand side of FIG. 5, the tube bends 26, 26' are connected by means of fixed tube segments 60 which, in order to absorb temperature-related movements between the cooling plates, are substantially in the shape of racing cycle handlebars. In the cooling plates on the right-hand side of FIG. 5, the tube bends 26, 26' are connected by means of metal hoses 62.

Figure 6:
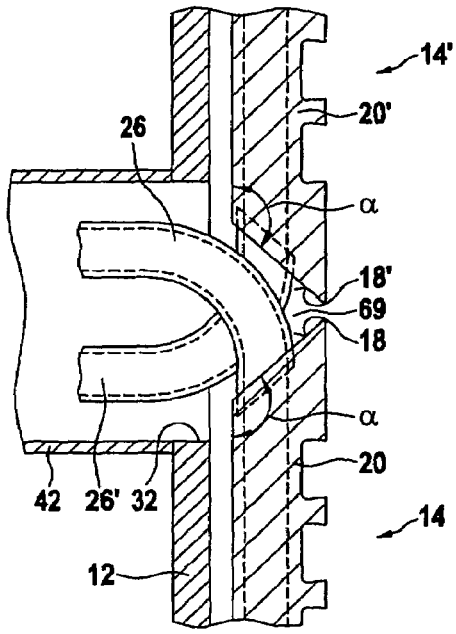
FIG. 6: is a longitudinal section through a third embodiment of a cooled furnace wall.

FIG. 6 shows a further embodiment of the cooled furnace wall. In this embodiment, the two edge faces 18, 18' of the cooling plates 14, 14' out of which bent connection pieces 26, 26' are led out of the plate bodies 20, 20' are bevelled in mirror-image fashion towards the inner side of the furnace shell 12, in such a manner that they delimit a wedge-shaped space 69 which narrows towards the interior of the furnace. The angle a between the respective rear side of the cooling plate 14, 14' and the corresponding edge face 18, 18' is advantageously in the range from 105° to 150° and is preferably 120°. In the wedge-shaped space 69, the bent connection pieces 26, 26' are substantially shielded from the thermal radiation from the interior of the furnace. They are located, so to speak, in the shadow of the edges of the cooling plates 14, 14'. Moreover, the wedge-shaped space 69 may be filled with a refractory material, in which case, however, the expansion of the cooling plates 14, 14' and their connection pieces must not be excessively impeded. Since the bent connection pieces 26, 26' are now relatively well protected from thermal radiation, they may also be made, for example, from stainless steel. In this context, it should be noted that tube bends made from stainless steel have better mechanical properties and lower prices than thick-walled tube bends made from copper.

Figure 7:
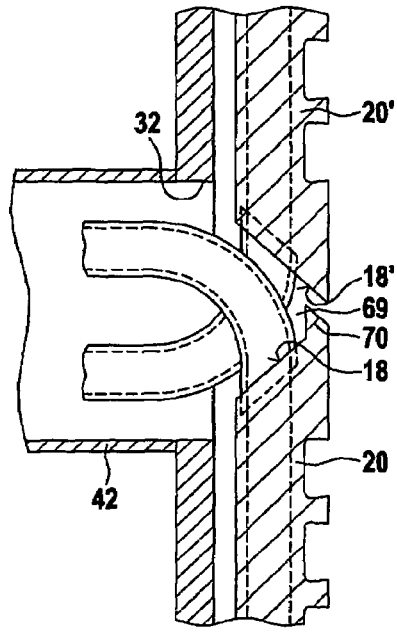
FIG. 7: is a longitudinal section through a first variant of the embodiment shown in FIG. 6.

FIG. 7 shows a modification to the embodiment shown in FIG. 6. The two plate bodies 20, 20' are arranged vertically above one another on the inner side of the furnace shell. The edge face 18 of the lower plate body 20 has a nose-like projection 70 facing the interior of the furnace, which is bevelled parallel to the opposite edge face 18' of the upper plate body 20', so that this nose-like projection 70 and the edge face 18' of the upper plate body 20' form a gap 72 which slopes from the interior of the furnace upwards towards the inner side of the furnace shell 12. This gap 72 which rises upwards towards the inner side of the furnace shell 12 makes it more difficult, for example, for settling burden to penetrate into the wedge-shaped space 69.

Figure 8:
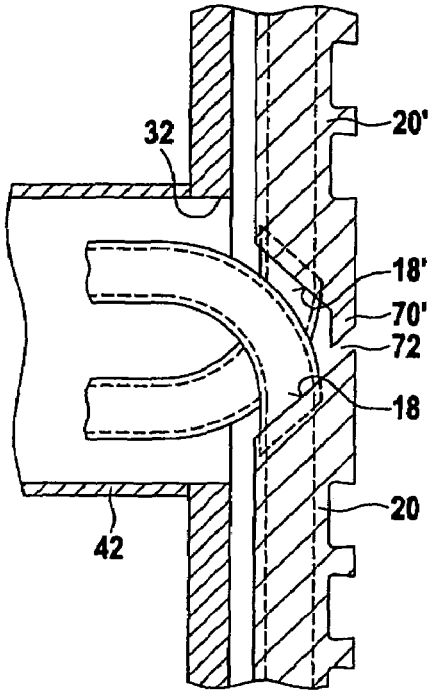
FIG. 8 is a longitudinal section through a second variant of the embodiment shown in FIG. 6.

FIG. 8 shows a modification to the embodiment shown in FIG. 7. The edge face 18' of the upper plate body 20' has a nose-like projection 70' facing the interior of the furnace, which is bevelled parallel to the edge face 18 of the lower plate body 20, so that this nose-like projection 70, and the edge face 18 of the lower plate body 20 form a gap 72 which slopes from the interior of the furnace downwards towards the inner side of the furnace shell 12. This gap sloping downwards in the direction of the inner side of the furnace shell 12 makes it more difficult for hot gases to penetrate into the wedge-shaped space 69.

Figure 9:
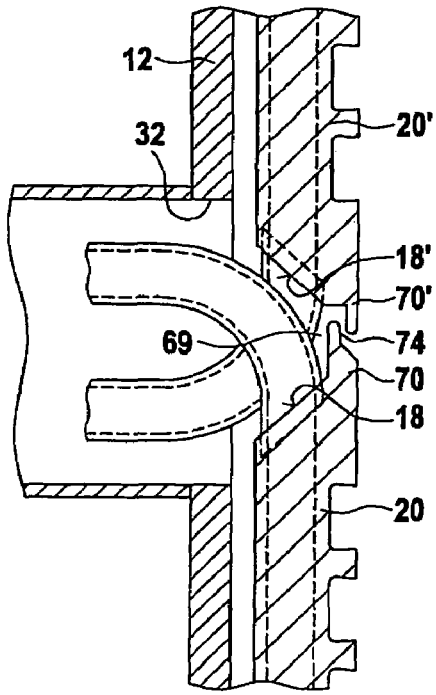
FIG. 9: is a longitudinal section through a third variant of the embodiment shown in FIG. 6.

FIG. 9 shows a further modification to the embodiment shown in FIG. 7. In this case, the two bevelled edge faces 18, 18' each have a nose-like projection 70, 70' facing towards the interior of the furnace, which nose-like projections overlap one another. In this case the two nose-like projections 70, 70' are separated by a type of labyrinth gap 74. The latter makes it more difficult for hot gases and settling burden to penetrate into the wedge-shaped space 69.

Figure 10:
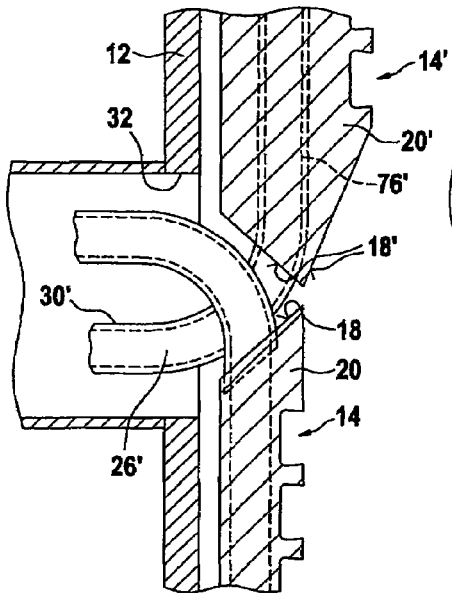
FIG. 10: is a longitudinal section through a fourth embodiment of a cooled furnace wall.

FIG. 10 shows a further embodiment of the cooled furnace wall. The lower cooling plate 14 comprises a plate body 20 made from copper or steel. However, the upper cooling plate 14' comprises a plate body 20' made from cast iron in which the cooling passages are formed by cast-in tubes 76'. The end of a tube 76' of this type is led out of the edge face 18' of the plate body 20', where it forms a bent connection piece 26' with a connection end 30' which is guided through the connection openings 32 in the furnace shell 12. It will be noted that the edge face 18' is bevelled at the front and at the rear, the bent connection piece 26' emerging from the edge face bevelled at the rear. The bevelling towards the interior of the furnace results in an improved transition between the cooling plate 14' made from cast iron and the thinner cooling plate 14 made from copper or steel.

Figure 11:
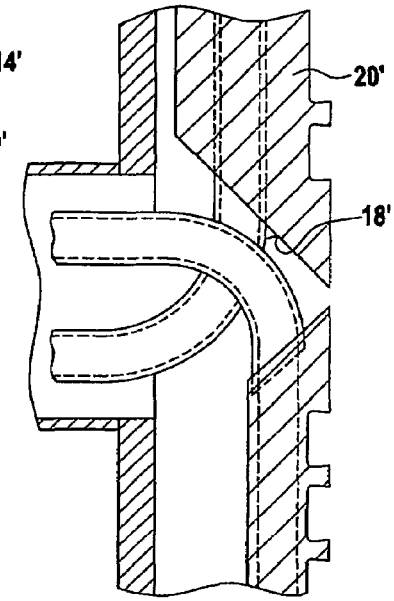
FIG. 11: is a longitudinal section through a first variant of the embodiment shown in FIG. 10.

FIG. 11 shows a modification to the embodiment shown in FIG. 10. In this embodiment, the upper plate body 20' made from cast iron, like the lower cooling plate 14 made from copper or steel, has an edge face 18' which is bevelled exclusively at the rear. Since the two front sides of the plate bodies 20 and 20' are flush, the gap between the rear side of the plate body 20 made from copper or steel and the furnace shell 12 is wider than the gap between the rear side of the thicker plate body 20' made from cast iron and the furnace shell 12. However, the gap between the rear side of the plate body 20 made from copper or steel and the furnace shell 12 can be reduced, for example, by a constriction in the furnace shell (not shown).

Figure 12:
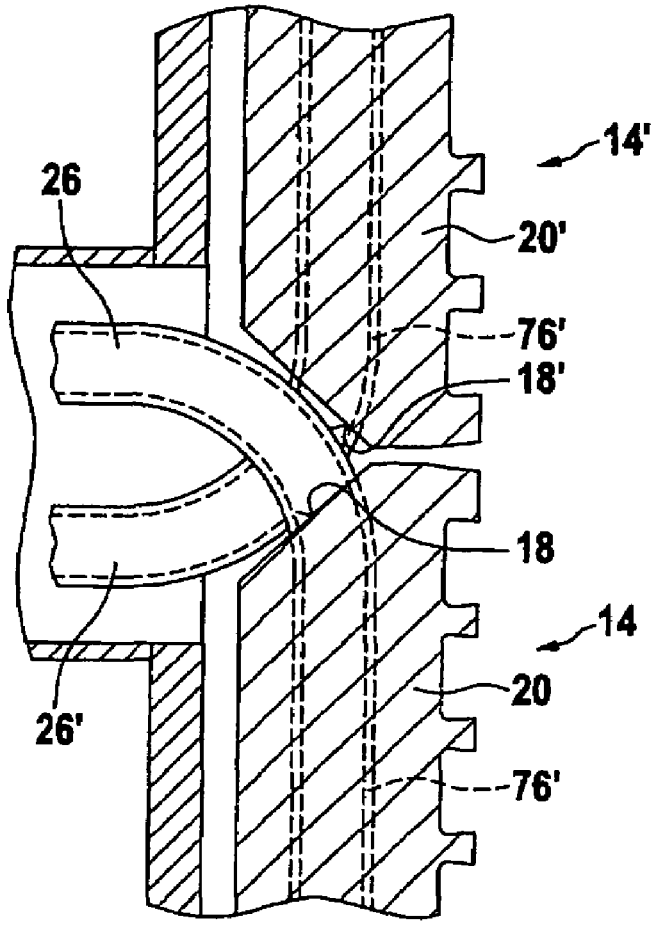
FIG. 12: is a longitudinal section through a fifth embodiment of a cooled furnace wall.

FIG. 12 shows a further embodiment of the cooled furnace wall. Both the lower cooling plate 14 and the upper cooling plate 14' comprise a plate body 20, 20' made from cast iron in which the cooling passages are formed by cast-in tubes 76, 76'. The edge face 18, 18' is in each case partially bevelled at the rear, the tube bend 26, 26' emerging from the edge face which is bevelled towards the rear.

FIG. 13 shows a cooling plate arrangement as in FIG. 6 with further design details. It can be seen that a plug 80 with through-openings for the connection ends 30, 30' of the bent connection pieces 26, 26' has been inserted into the connection opening 32 in the furnace shell 12. The plug 80 consists of an elastic material, so that it does not significantly impede the free expansion of the connection pieces 26, 26' and cooling plates 14, 14'. At its edge, it has an encircling securing flange 82 which is clamped between the cooling plates 14, 14' and the furnace shell 12. The connection ends 30, 30' are guided through the through-openings in the plug 80 into the connection box 42, where they are connected to one another by means of a flexible connection line 84 with quick-acting couplings 86, 86'. Immediately behind the plug 80, a partial section of the connection box 42 is filled with a foamed elastic material 83 around the connection ends 30, 30'. The rear end of the connection box 42, which is not filled with foam and in which the connecting line 84 is arranged, has a leak-test valve 88 at its lowest point. In the event of a leak in the connections between the connection pieces 26, 26', cooling water collects in the rear end of the connection box 42. The leak-test valve 88 can be used to check the connection box 42 for the presence of leakage water without the blind flange 44 of the connection box 42 having to be opened.

Figure 14:
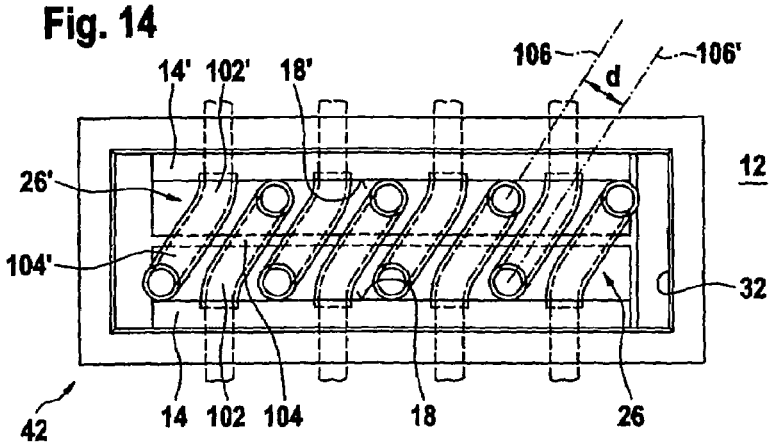
FIG. 14: is a plan view of a connection box in which connection pieces of two cooling plates are connected to one another.

FIG. 14 shows a plan view of a connection box 42 in which a plurality of connection pieces 26, 26' of two cooling plates 14, 14' are connected to one another. It can be seen that each of the bent connection pieces 26, 26', at the exit from the edge face 18, 18' of the plate body 20, 20', first of all has a first curvature 102, 102' in the mid-plane of the plate body 20, 20' (=plane parallel to the plane of the drawing) and then a second curvature 104, 104' in a plane which is perpendicular to the mid-plane of the plate body 20, 20'. The connection pieces 26, 26' shown are composed, for example, of a 30° tube bend and a 90° tube bend, the centre lines of which lie in two mutually perpendicular planes.

In FIG. 14, the cooling plates 14, 14 are positioned above one another, in such a manner that the outlet point of a bent connection piece 26 in an edge face 18 of the first cooling plate 14 and the outlet point of a bent connection piece 26' in an opposite edge face 18' of the second cooling plate 14' lie axially opposite one another. The first curvature 102 of a bent connection piece 26 of the first cooling plate 14 is directed towards the right. By contrast, the first curvature 102' of a bent connection piece 26' of the second cooling plate 14' is directed towards the left, i.e. in the opposite direction. The planes of curvature 106, 106' of the second curvatures 104, 104' are parallel to one another and have a spacing "d" between them which corresponds to 1.1 to 1.5 times the tube diameter of the bent connection pieces (26, 26'). It will be noted that the double curvature of the connection pieces 26, 26' makes it possible for the two cooling plates 14, 14' to be arranged very close together.

Figure 15:
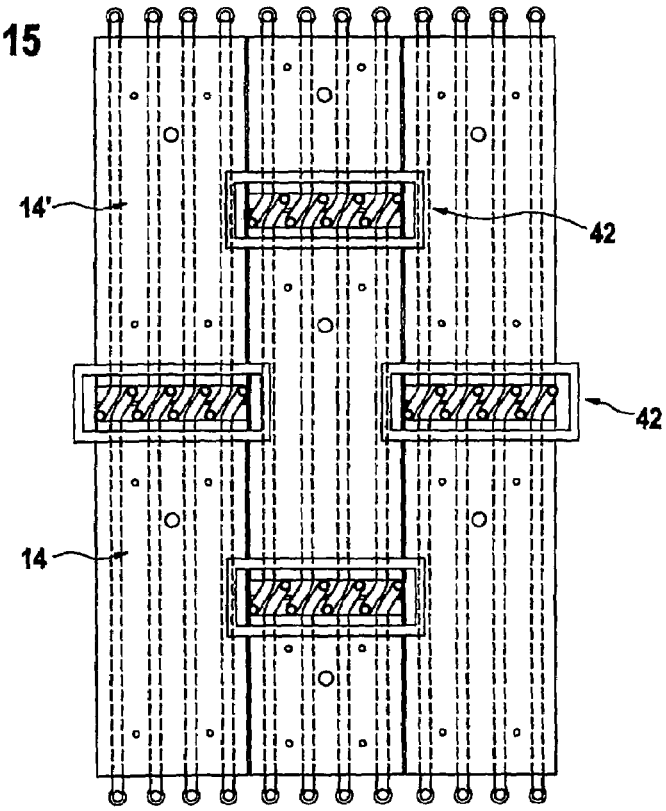
FIG. 15: is a plan view of an arrangement of cooling plates with connection boxes in accordance with FIG. 14.

FIG. 15 shows an arrangement of cooling plates with connection boxes 42 as shown in FIG. 14. Each of the connection boxes 42 can be used to install and remove a cooling plate 14, 14'. It will be seen how the connection boxes 42 are offset in terms of height in order not to excessively weaken the furnace shell 12.

Figure 16:
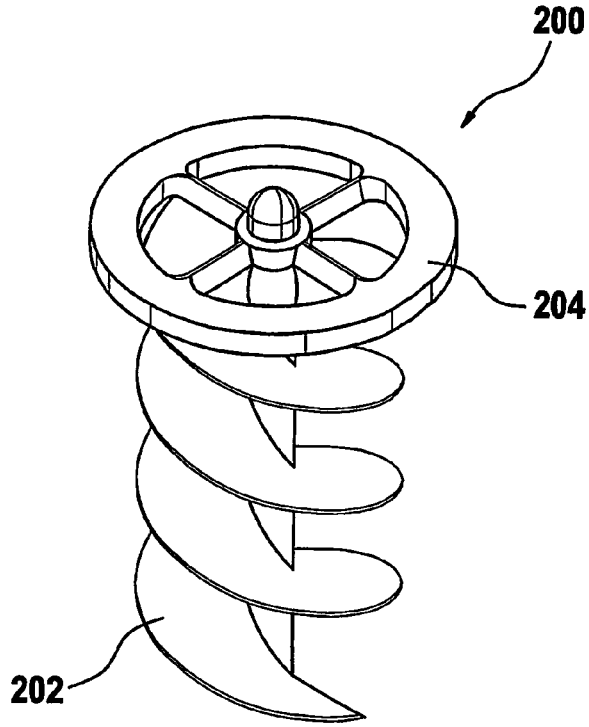
FIG. 16: is a three-dimensional view of a first embodiment of a turbulator to be inserted in a cooling passage of a cooling plate.
Figure 17:
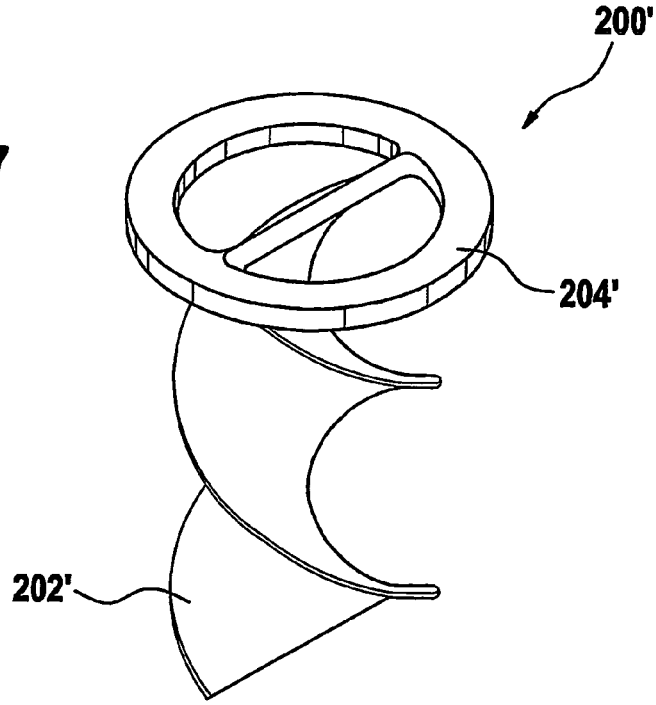
FIG. 17: is a three-dimensional view of a second embodiment of a turbulator to be inserted in a cooling passage of a cooling plate.

It will be appreciated that the tube bend connection piece may advantageously be used to mount a turbulator into a cooling passage of the cooling plate. FIG. 16 and FIG. 17 show possible embodiments of such a turbulator 200, 200'. The latter comprises a turbulator body 202, 202' and a ring-shaped fixing flange 204, 204'. The turbulator body 202, 202' is axially inserted into the cooling channel. The ring-shape fixing flange 204, 204' bears on a shoulder surface in the opening of the cooling channel in the edge face of the cooling plate. It is blocked on this shoulder surface by means of the connection piece, whose end is inserted into this opening and sealingly connected to the edge face by means of a welding or brazing joint. Such a turbulator will increase efficiency of thermal transfer by adding a transversal velocity component to the cooling fluid in the cooling channel.

The invention claimed is:

1. A cooled furnace wall comprising:

a furnace shell with connection openings therein, said furnace shell having an inner and an outer side; and cooling plates lining said inner side of said furnace shell, each of said cooling plates having a plate body and protruding connection pieces extending through said connection openings for supplying said cooling plate with a coolant;

wherein at least one of said protruding connection pieces is a tube bend connection piece formed by a tube bend that protrudes from an edge face of said plate body and that has a connection end extending through one of the connection openings in said furnace shell where it is interconnected to a connection piece of an adjacent cooling plate from said outer side of said furnace shell.

2. The furnace wall according to claim 1, comprising:

a flexible connection means interconnecting said connection end of a tube bend connection piece from a first cooling plate to said connection end of a tube bend connection piece from a adjacent cooling plate.

3. The furnace wall according to claim 2, wherein:

said connection opening in said furnace shell is covered by a socket piece that has for each connection end a separate through-opening; and each of said connection ends is connected in a sealed manner to said socket piece by means of a compensator.

4. The furnace wall according to claim 2, wherein said cooling plates lining said inner side of said furnace shell comprise:

a lower row of cooling plates separated by vertical joins;

an upper row of cooling plates separated by vertical joins and located vertically directly above said lower row;

wherein said vertical joins separating the cooling plates of said upper row are offset relative to said vertical joins separating the cooling plates of said lower row.

5. The furnace wall according to claim 4, wherein:

said tube bend connection pieces of a cooling plate of said lower row are connected to said tube bend connection pieces of two adjacent cooling plates of said upper row.

6. The furnace wall according to claim 1, comprising:

a connection box that is arranged on said outer side of said furnace shell above one of said connection openings;

wherein connection ends of said tube bend connection pieces extend into said connection box where they are interconnected by means of flexible connection means.

7. The furnace wall according to claim 6, wherein said connection box is sealed off by means of a removable blind flange.

8. The furnace wall according to claim 7, wherein said connection box is dimensioned so that one of said cooling plates can be removed from said furnace or introduced into said furnace through said connection box.

9. The furnace wall according to claim 8, wherein adjacent connection openings in the furnace shell are vertically offset.

10. The furnace wall according to claim 6, wherein said flexible connection means comprises a compensation tube bend which is arranged in said connection box.

11. The furnace wall according to claim 6, wherein said flexible connection means comprises a bent tube segment which is arranged in said connection box and is substantially in the shape of racing cycle handlebars.

12. The furnace wall according to claim 6, wherein said flexible connection means comprises a metal hose which is arranged in said connection box where it is coupled to said connection ends of a pair of tube bend connection pieces.

13. The furnace wall according to claim 1, wherein:

a plate extension is arranged at said edge face of said cooling plate in front of said tube bend connection pieces, so that it shields said tube bend connection pieces with respect to the interior of the furnace.

14. The furnace wall according to claim 1, wherein said edge face of the plate body from which said tube bend connection piece protrudes is bevelled towards said inner side of said furnace shell.

15. The furnace wall according to claim 14, wherein said bevelled edge face forms an angle of between 105° and 135° with respect to the rear side of said cooling plate.

16. The furnace wall according to claim 15, wherein said bevelled edge face forms an angle of approximately 120° with the rear side of said cooling plate.

17. The furnace wall according to claim 14, wherein for two cooling plates which are interconnected by means of said tube bend connection pieces, the opposite edge faces from which said tube bend connection pieces protrude are bevelled in a mirror image, so that they delimit a wedge-shaped space which narrows towards the interior of said furnace.

18. The furnace wall according to claim 17, wherein:

the plate bodies of said two cooling plates are arranged vertically directly above one another, so that an upper edge face of the lower plate body is directly facing a lower edge face of the upper plate body; and said upper edge face of the lower plate body has a nose-like projection which is bevelled parallel to said lower edge face of the upper plate body, so that said nose-like projection and said lower edge face of the upper plate body form a gap which slopes upwards towards said inner side of said furnace shell.

19. The furnace wall according to claim 18, wherein:

the plate bodies of said two cooling plates are arranged vertically directly above one another, so that an upper edge face of the lower plate body is directly facing a lower edge face of the upper plate body; and said lower edge face of the upper plate body has a nose-like projection which is bevelled parallel to said upper edge face of the lower plate body, so that said nose-like projection and said upper edge face of the lower plate body form a gap which slopes downwards towards said inner side of said furnace shell.

20. The furnace wall according to claim 18, wherein the two bevelled edge faces each have a nose-like projection facing towards the interior of the furnace, and the two nose-like projections overlap.

21. The furnace wall according to claim 1, wherein said tube bend connection pieces have at the outlet from said edge face a first curvature in a mid-plane of said plate body and thereafter a second curvature in a plane perpendicular to said mid-plane of said plate body.

22. The furnace wall according to claim 21, wherein such a tube bend connection piece is composed of a 30° tube bend and a 90° tube bend, the centre lines of which lie in planes which are perpendicular to one another.

23. The furnace wall according to claim 21, comprising:

two adjacent cooling plates, which are arranged above or next to one another in such a manner that the outlet of a tube bend connection piece in one edge face of the first cooling plate and the outlet of a tube bend connection piece in an opposite edge face of the second cooling plate lie axially opposite one another;

wherein:

said first curvature of a tube bend connection piece of said first cooling plate is directed in a first direction, and said first curvature of a tube bend connection piece of said second cooling plate is directed in the opposite direction.

24. The furnace wall according to claim 23, wherein:

said second curvature of said tube bend connection piece of said first cooling plate and said second curvature of said tube bend connection piece of said second cooling plate define parallel planes of curvature; and the distance between two of such parallel planes of curvature that are adjacent corresponds to 1.1 to 1.5 times the tube diameter of said tube bends.

25. The furnace wall according to claim 23, wherein:

the opposite edge faces of the two plate bodies are bevelled in mirror-image fashion, so as to delimit a wedge-shaped space which narrows towards the interior of the furnace;

said connection end of a tube bend connection piece of said first cooling plate extends through said connection opening behind the bevelled edge face of said second cooling plate; and said connection end of a tube bend connection piece of said second cooling plate extends through said same connection opening behind the bevelled edge face of said first cooling plate.

26. The furnace wall according to claim 1, comprising a plug made from an elastic material that is inserted into one of said connection openings in said furnace shell.

27. The furnace wall according to claim 26, wherein said plug has a lateral securing flange which is clamped between said cooling plates and said furnace shell.

28. The furnace wall according to claim 26, wherein:

on said outer side of said furnace shell, a connection box is arranged above said connection opening;

at least two connection ends extend through said plug into this connection box, where they are interconnected by means of flexible connection means; and a section of said connection box between said plug and said flexible connection means is sealed with a foamed sealing material.

29. The furnace wall according to claim 28, wherein said connection box has a leak-test valve at its lowest point.

30. The furnace wall according to claim 1, wherein:

at least one of said cooling plates lining said inner side of said furnace shell has at least one cooling passage which is formed directly in said plate body;

said cooling passage forms an opening in said edge face of said plate body; and a first end of said tube bend is inserted into said opening in said edge face.

31. The furnace wall according to claim 30, further including a turbulator mounted in said cooling passage, wherein:

said turbulator includes a turbulator body and a ring-shaped fixing flange;

said turbulator body is axially inserted into said cooling passage;

said ring-shape fixing flange bears on a shoulder surface in said opening of said cooling channel; and said ring-shape fixing flange is blocked on said shoulder surface by means of said first end of said tube bend that is inserted into said opening in said edge face.

32. The furnace wall according to claim 1, wherein:

at least one of said cooling plates lining said inner side of said furnace shell has at least one cooling passage which is formed by a cast-in tube; and at least one end of said tubes protrudes from an edge face of said plate body and forms said tube bend connection piece.

* * * * *